US010858618B2

(12) United States Patent
Fernandez-Prieto et al.

(10) Patent No.: US 10,858,618 B2
(45) Date of Patent: Dec. 8, 2020

(54) DETERGENT COMPOSITIONS

(71) Applicant: The Procter & Gamble Company, Cincinnati, OH (US)

(72) Inventors: Susana Fernandez-Prieto, Benicassim (BE); Pieter Jan Maria Saveyn, Destelbergen (BE); Johan Smets, Lubbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 110 days.

(21) Appl. No.: 15/721,982

(22) Filed: Oct. 2, 2017

(65) Prior Publication Data

US 2018/0148673 A1 May 31, 2018

(30) Foreign Application Priority Data

Sep. 12, 2016 (EP) ..... 16188345

(51) Int. Cl.

| | |
|---|---|
| ***C11D 1/00*** | (2006.01) |
| ***C11D 3/50*** | (2006.01) |
| ***C11D 17/00*** | (2006.01) |
| ***C11D 3/22*** | (2006.01) |
| ***C11D 3/382*** | (2006.01) |
| ***C11D 11/00*** | (2006.01) |

(52) U.S. Cl.

CPC ..... *C11D 3/505* (2013.01); *C11D 3/222* (2013.01); *C11D 3/382* (2013.01); *C11D 11/0017* (2013.01); *C11D 17/0026* (2013.01); *C11D 17/0039* (2013.01)

(58) Field of Classification Search

None

See application file for complete search history.

(56) References Cited

U.S. PATENT DOCUMENTS 5,964,983 A * 10/1999 Dinand ..... C09K 8/206 162/187
2008/0146485 A1* 6/2008 Swazey ..... A61K 8/731 510/446

FOREIGN PATENT DOCUMENTS

| | | | |
|---|---|---|---|
| WO | WO 2009/101545 | A1 | 8/2009 |
| WO | WO 2010/048154 | A2 | 4/2010 |
| WO | WO 2011/054389 | A1 | 5/2011 |
| WO | WO 2012/065925 | A1 | 5/2012 |
| WO | WO 2013/160023 | A1 | 10/2013 |
| WO | WO 2015/006635 | A1 | 1/2015 |
| WO | WO 2015/116763 | A1 | 8/2015 |

OTHER PUBLICATIONS

EP Search Report for CM04601F (Application No. 16188345.9-1375) dated Feb. 22, 2017.

* cited by examiner

*Primary Examiner* — Necholus Ogden, Jr.
(74) *Attorney, Agent, or Firm* — Carrie Schwartz; Andrés E. Velarde

(57) ABSTRACT

A detergent composition and processes for making and using same. A detergent composition that includes cellulose fibers to improve the deposition and/or retention of encapsulated benefit agent onto fabrics.

16 Claims, No Drawings

DETERGENT COMPOSITIONS

FIELD OF THE INVENTION

The present disclosure is directed to detergent compositions comprising cellulose fibers to improve the deposition and/or retention of encapsulated benefit agent onto fabrics.

BACKGROUND OF THE INVENTION

Benefit agents such as perfumes or moisturizers are important ingredients of detergent compositions. However, benefit agents are often expensive components therefore encapsulation or other controlled release systems are used in order to improve the delivery of the benefit agent during use. A problem in the field is that much of the benefit agents are either not deposited or rinsed away before use. Thus, there is a need to improve the efficiency of deposition and/or retention of benefit agents onto fabrics.

Detergent compositions comprising a surfactant, micro-fibrous cellulose and perfume capsules are known. Compositions containing fragrance or perfume containing particular polysaccharide derivatives and branched polyglycerol-modified silicone are known. A structurant consisting of bacterially produced micro-fibrous cellulose combined with carboxymethyl cellulose and xanthan gum as dispersion aids is known. Surfactant systems which use micro-fibrous cellulose to suspend particulates therein are known. A structured liquid detergent composition in the form of a liquid matrix made up of an external structuring system of a bacterial cellulose network, water, and surfactant system including an anionic surfactant, a nonionic surfactant, a cationic surfactant, an ampholytic surfactant, a zwitterionic surfactant or combinations thereof is known. A process for the manufacture of core shell perfume capsules by emulsion polymerisation and the products obtainable by such a process are known. It is known to provide capsules where the core of the capsules comprises a perfume and the shell (which preferably comprises an aminoplast polymer) also comprises a non-ionic deposition aid (such as locust bean gum) which is substantive to textiles. A capsule comprising a benefit agent core (preferably containing perfume), one or more inner shells (preferably of melamine urea or melamine formaldehyde) and an outer shell comprising a polymer is known. An externally structured aqueous isotropic liquid detergent composition comprising: a mixed surfactant system comprising anionic surfactant, an external structuring system comprising an insoluble cellulosic fiber comprising at least 50 wt % activated citrus fibers, and at least 0.01 wt % of suspended non-clay solid particles, characterized in that the external structuring system further comprises at least 0.1 wt % water-swellable clay is known.

SUMMARY OF THE INVENTION

It has surprisingly been found that detergent compositions comprising cellulose fibers wherein at least 80% of said cellulose fibers have a hydrodynamic radius above 5 microns increase deposition and/or retention of benefit agents delivery systems on fabrics.

As such, the present disclosure relates to a detergent composition, comprising, based on the total detergent composition weight, from 0.01 to 90% of a detersive surfactant; from 0.01 to 5% of cellulose fibers wherein at least 80% of said cellulose fibers have a hydrodynamic radius above 5 microns and, from 0.05 to 10% of encapsulated benefit agent.

The present disclosure further relates to a process of making the detergent composition of the first aspect of the invention.

The present disclosure further relates to a method of treating a textile with the composition of the first aspect of the invention.

The present disclosure further relates to the use of cellulose fibers wherein at least 80% of said cellulose fibers have a hydrodynamic radius above 5 microns to increase the retention and/or deposition of encapsulated benefit agent on fabrics.

DETAILED DESCRIPTION OF THE INVENTION

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

All measurements are performed at 25° C. unless otherwise specified.

As used herein, the articles including "a" and "an" when used in a claim, are understood to mean one or more of what is claimed or described.

Detergent Composition:

As used herein, "liquid detergent composition" refers to any treatment composition comprising a fluid capable of wetting and cleaning a substrate. Especially preferred are liquid laundry detergent compositions suitable for washing fabrics e.g., clothing in a domestic washing machine. The composition can include solids or gases in suitably subdivided form, but the overall composition excludes product forms which are non-fluid overall, such as tablets or granules. The liquid detergent composition preferably has a density in the range from 0.9 to 1.3 grams per cubic centimeter, more specifically from 1.00 to 1.10 grams per cubic centimeter, excluding any solid additives but including any bubbles, if present.

Aqueous liquid detergent compositions are preferred. For such aqueous liquid detergent compositions, the water content can be present at a level of from 5% to 99%, preferably from 15% to 85%, more preferably from 45% to 70% by weight of the liquid detergent composition. The pH range of the detergent composition may be from pH 5 to 12, preferably from pH 7 to 9. The pH is measured on the neat composition, at 25° C., using a Sartarius PT-10P pH meter with gel-filled probe (such as the Toledo probe, part number 52 000 100), calibrated according to the instructions manual.

Detersive Surfactants

The liquid detergent composition comprises the detersive surfactant at a level of from 1 wt % to 90 wt %, preferably from 10 wt % to 50 wt %, more preferably from 15 wt % to 30 wt %. Detersive surfactant as used herein means surfactants or mixtures of surfactants that provide cleaning, stain removing, or laundering benefit to soiled material. Suitable detersive surfactants can be: anionic surfactant, nonionic surfactant, zwitterionic surfactant, and combinations thereof. Preferably, the surfactants are selected from the group consisting of: anionic surfactants, nonionic surfactants and combinations thereof.

Preferably surfactants comprising saturated alkyl chains are used.

The cleaning surfactant typically comprises anionic surfactant. In preferred liquid detergent compositions, the cleaning surfactant can comprise the anionic surfactant at a level of from 1 wt % to 50 wt %, preferably from 10 wt % to 40 wt %, more preferably from 15 wt % to 30 wt %.

Suitable anionic surfactants can be selected from the group consisting of: alkyl sulphates, alkyl ethoxy sulphates, alkyl sulphonates, alkyl benzene sulphonates, fatty acids and their salts, and mixtures thereof. However, by nature, every anionic surfactant known in the art of detergent compositions may be used, such as disclosed in "Surfactant Science Series", Vol. 7, edited by W. M. Linfield, Marcel Dekker. However, the composition preferably comprises at least a sulphonic acid surfactant, such as a linear alkyl benzene sulphonic acid, but water-soluble salt forms may also be used, alkyl ethoxy sulphates, or mixtures thereof.

Anionic sulfonate or sulfonic acid surfactants suitable for use herein include the acid and salt forms of linear or branched C5-C20, more preferably C10-C16, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates. The aforementioned surfactants can vary widely in their 2-phenyl isomer content.

Anionic sulphate salts suitable for use in the compositions of the invention include the primary and secondary alkyl sulphates, having a linear or branched alkyl or alkenyl moiety having from 9 to 22 carbon atoms or more preferably 12 to18 carbon atoms. Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl alkoxylated sulphates such as alkyl ethoxy sulphates (AES) and/or alkyl polyalkoxylated carboxylates (AEC).

The anionic surfactants are typically present in the form of their salts with alkanolamines or alkali metals such as sodium and potassium.

For improved stability, the liquid detergent composition can comprise linear alkyl benzene sulfonate surfactant and alkyl alkoxylated sulphate surfactant, such that the ratio of linear alkyl benzene sulfonate surfactant to alkyl alkoxylated sulphate surfactant is from 0.1 to 5, preferably from 0.25 to 3, more preferably from 0.75 to 1.5. When used, the alkyl alkoxylated sulphate surfactant is preferably a blend of one or more alkyl ethoxylated sulphates, more preferably having a degree of ethoxylation of from 1 to 10, most preferably from 1.8 to 4.

The liquid detergent composition can comprise nonionic surfactant. The level of nonionic surfactant in the liquid detergent composition can be present at a level of less than 10 wt %, preferably less than 5 wt %, more preferably less than 1 wt %, most preferably less than 0.5 wt %.

Suitable nonionic surfactants include, but are not limited to C12-C18 alkyl ethoxylates ("AE") including the so-called narrow peaked alkyl ethoxylates and C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic—BASF Corp.), as well as semi polar nonionics (e.g., amine oxides and phosphine oxides) can be used in the present compositions. An extensive disclosure of these types of surfactants is found in U.S. Pat. No. 3,929,678, Laughlin et al., issued Dec. 30, 1975.

Alkylpolysaccharides such as disclosed in U.S. Pat. No. 4,565,647 Llenado are also useful nonionic surfactants in the compositions of the invention.

Also suitable are alkyl polyglucoside surfactants.

In some embodiments, nonionic surfactants of use include those of the formula $R_1(OC_2H_4)_nOH$, wherein $R_1$ is a C10-C16 alkyl group or a C8-C12 alkyl phenyl group, and n is from preferably 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol Additional suitable nonionic surfactants include polyhydroxy fatty acid amides of the formula:

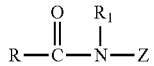

wherein R is a C9-17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798.

The liquid detergent composition can comprise a zwitterion. The zwitterion can be present at a level of from 0.1 wt % to 5 wt %, preferably from 0.2 wt % to 2 wt %, more preferably from 0.4 wt % to 1 wt %.

Suitable amphoteric or zwitterionic detersive surfactants include those which are known for use in hair care or other personal care cleansing. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.). Suitable amphoteric detersive surfactants include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Cellulose Fibers:

Cellulose fibers of the present invention surprisingly increase the deposition and/or retention of encapsulated benefit agent onto fabrics. They may also provide rheology benefits.

The detergent composition of the present invention comprises, based on the total detergent composition weight, from 0.01 to 5%, preferably 0.05 to 1%, more preferably from 0.1 to 0.75% of cellulose fibers. The cellulose fibers are processed from the respective raw material such that at least 80% of said cellulose fibers have a hydrodynamic radius above 5 microns. Preferably, at least 80% of said cellulose fibers have a hydrodynamic radius between 5 and 65 microns, more preferably between 10 and 55 microns. Such fibers are commercially available, for instance Citri-Fi 100FG from Fiberstar, Herbacel® Classic from Herbafood, and Exilva® from Borregaard.

The cellulose fibers are preferably prepared and processed using limited shear stress, in order to maintain the fiber hydrodynamic radius, and chemical treatments which overly shorten the fibers are preferably avoided.

By cellulose fibers it is meant herein cellulose micro or nano fibrils. The cellulose fibers can be of bacterial or botanical origin, i.e. produced by fermentation or extracted from vegetables, plants, fruits or wood. Cellulose fiber sources may be selected from the group consisting of citrus peels, such as lemons, oranges and/or grapefruit; fruits, such as apples, bananas and/or pear; vegetables such as carrots, peas, potatoes and/or chicory; plants such as bamboo, jute, abaca, flax, cotton and/or sisal, cereals, and different wood sources such as spruces, *eucalyptus* and/or oak. Preferably, the cellulose fibers source may be selected from the group consisting of wood or jute. The content of cellulose will vary depending on the source and treatment applied for the extraction of the fibers, and will range from 15 to 100%, preferably above 30%, more preferably above 50%, and even more preferably above 80%.

Such cellulose fibers may comprise pectin, hemicellulose, proteins, lignin and other impurities inherent to the cellulose based material source such as ash, metals, salts and combinations thereof.

The cellulose fibers are preferably non-ionic.

Encapsulated Benefit Agent:

The laundry detergent comprises from 0.05 to 10%, preferably from 0.05 to 3%, more preferably from 0.05 to 2% by weight of encapsulated benefit agent. The benefit agent is selected from the group consisting of perfume composition, moisturizers, a heating or cooling agent, an insect/moth repellent, germ/mould/mildew control agents, softening agents, antistatic agents, anti-allergenic agents, UV protection agents, sun fade inhibitors, hueing dyes, enzymes and combinations thereof, color protection agents such as dye transfer inhibitors, bleach agents, and combinations thereof. Perfume compositions are preferred.

The benefit agent is encapsulated, for instance, as part of a core in one or more capsules. Such cores can comprise other materials, such as diluents, solvents and density balancing agents.

The capsules have a wall, which at least partially, preferably fully surrounds the benefit agent comprising core. The capsule wall material may be selected from the group consisting of melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals (such as 1,3,5-triol-benzene-gluteraldehyde and 1,3,5-triol-benzene melamine), starch, cellulose acetate phthalate and mixtures thereof.

Preferably, the capsule wall comprises one or more wall material comprising melamine, polyacrylate based material and combinations thereof.

Said melamine wall material may be selected from the group consisting of melamine crosslinked with formaldehyde, melamine-dimethoxyethanol crosslinked with formaldehyde, and combinations thereof.

Said polyacrylate based material may be selected from the group consisting of polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer and combinations thereof.

Said polystyrene wall material may be selected from polyestyrene cross-linked with divinylbenzene.

Said polyurea wall material may be selected from urea crosslinked with formaldehyde, urea crosslinked with gluteraldehyde, and combinations thereof.

Preferably, said perfume capsules have a volume weighted mean particle size from 0.5 microns to 100 microns, preferably from 1 microns to 60 microns, preferably from 5 microns to 40 microns.

The volume-weighted particle size distribution (PSD) is determined via single-particle optical sensing (SPOS), also called optical particle counting (OPC), using the AccuSizer 780 AD instrument and the accompanying software CW788 version 1.82 (Particle Sizing Systems, Santa Barbara, Calif., U.S.A.).

Preferably, the capsules may comprise a core which comprises perfume, and a wall which comprises melamine formaldehyde and/or cross linked melamine formaldehyde.

In order to further improve deposition, the wall further comprises a coating on the outer surface of the wall, wherein the coating comprises a further deposition aid, as described herein. Polyvinyl formamide polymer is the preferred deposition aid. The polyvinyl formamide polymer can be partially hydrolysed.

Suitable capsules can be obtained from Encapsys (Appleton, Wis., USA). The detergent compositions may comprise combinations of different capsules, for example capsules having different wall materials and/or benefit agents.

As mentioned earlier, perfume compositions are the preferred benefit agent. The perfume composition comprises perfume raw materials. The perfume composition can further comprise essential oils, malodour reducing agents, odour controlling agents and combinations thereof.

The perfume raw materials are typically present in an amount of from 10 to 95% by total weight of the capsule, preferably from 20 to 90% of the total weight of the encapsulated benefit agent.

The perfume composition may comprise from 2.5% to 30%, preferably from 5% to 30% by weight of perfume raw materials characterized by a log P lower than 3.0, and a boiling point lower than 250° C.

The partition coefficient, P, is the ratio of concentrations of a compound in a mixture of two immiscible phases at equilibrium, in this case n-Octanol/Water. The value of the log of the Octanol/Water Partition Coefficient (log P) can be measured experimentally using well known means, such as the "shake-flask" method, measuring the distribution of the solute by UV/VIS spectroscopy (for example, as described in "The Measurement of Partition Coefficients", Molecular Informatics, Volume 7, Issue 3, 1988, Pages 133-144, by Dearden J C, Bresnan). Alternatively, the log P can be computed for each PRM in the perfume mixture being tested. The log P of an individual PRM is preferably calculated using the Consensus log P Computational Model, version 14.02 (Linux) available from Advanced Chemistry Development Inc. (ACD/Labs) (Toronto, Canada) to provide the unitless log P value. The ACD/Labs' Consensus log P Computational Model is part of the ACD/Labs model suite.

The perfume composition may comprise from 5% to 30%, preferably from 7% to 25% of perfume raw material characterized by having a log P lower than 3.0 and a boiling point higher than 250° C., from 35% to 60%. The perfume composition may comprise from 40% to 55% of perfume raw materials characterized by having a log P higher than 3.0 and a boiling point lower than 250° C. The perfume composition may comprise from 10% to 45%, preferably from 12% to 40% of perfume raw materials characterized by having a log P higher than 3.0 and a boiling point higher than 250° C.

Optional Ingredients

The detergent composition may additionally comprise one or more of the following optional ingredients:

Further deposition aid: For a further improved deposition benefit, the detergent composition may comprise a further deposition aid in addition to said cellulose fibers. The detergent composition may comprise, based on the total detergent composition weight, from 0.00001% to 5%, preferably from 0.0001 to 1%, more preferably from 0.001 to 0.5% of a further deposition aid in addition to said cellulose fibers The further deposition aid may be added directly to the detergent composition. Said deposition aid may alternatively, or in addition, be coated onto the outer wall of the capsule; the capsule may have a coating-to-wall weight ratio of from 1:200 to 1:2, or from 1:100 to 1:4, or even from 1:80 to 1:10.

The further deposition aid may comprise cationic or amphoteric deposition polymers. Cationic polymer may be selected from the group consisting of polysaccharides, cationically modified starch, cationically modified guar, chitosan, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and combinations thereof. Cationic polymer may comprise a cationic acrylate. The further deposition aid may be selected from the group consisting of polyvinyl amines, polyvinyl formamides, polyallyl amines, copolymers thereof, and combinations thereof. Preferably, The further deposition aid may be selected from the group consisting of polyvinylformamide, partially hydroxylated polyvinyl formamide, polyvinylamine, polyethylene imine, ethoxylated polyethylene imine, polyvinylalcohol, polyacrylates, and combinations thereof.

The polyvinyl formamide may have a hydrolysis degree of from 5% to 95%, from 7% to 60%, or even from 10% to 40%.

Formaldehyde scavenger: The detergent composition may comprise formaldehyde scavengers. Such scavengers may be useful in or with certain capsules, particularly capsules that comprise and/or release formaldehyde. Suitable formaldehyde scavengers may be selected from the group consisting of: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly (vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, and combinations thereof.

Further Perfume Delivery Technologies: The detergent composition may comprise one or more perfume delivery technologies that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1.

The detergent composition may comprise from 0.001% to 20%, or from 0.01% to 10%, or from 0.05% to 5%, or even from 0.1% to 0.5% by weight of such perfume delivery technologies. Said perfume delivery technologies may be selected from the group consisting of: pro-perfumes, cyclodextrins, starch encapsulated accord, zeolite and inorganic carrier, and combinations thereof.

Amine Reaction Product (ARP): For purposes of the present application, ARP is a subclass or species of pro-perfumes. One may also use "reactive" polymeric amines in which the amine functionality is pre-reacted with one or more PRMs to form an amine reaction product (ARP). Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Non-limiting examples of polymeric amines comprise polymers based on polyalkylimines, such as polyethyleneimine (PEI), or polyvinylamine (PVAm). Nonlimiting examples of monomeric (non-polymeric) amines comprise hydroxyl amines, such as 2-aminoethanol and its alkyl substituted derivatives, and aromatic amines such as anthranilates. The ARPs may be premixed with perfume or added separately in leave-on or rinse-off applications. A material that contains a heteroatom other than nitrogen, for example oxygen, sulfur, phosphorus or selenium, may be used as an alternative to amine compounds. The aforementioned alternative compounds can be used in combinations with amine compounds. A single molecule may comprise an amine moiety and one or more of the alternative heteroatom moieties, for example, thiols, phosphines and selenols. The benefit may comprise improved delivery of perfume as well as controlled perfume release.

Hueing Agents: The detergent composition may comprise fabric hueing agent (sometimes referred to as shading, bluing, or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and combinations thereof.

Fluorescent Agent: The detergent composition may comprise, based on the total detergent composition weight, from 0.005 to 2%, preferably 0.01 to 0.1% of a fluorescent agent (optical brightener). Fluorescent agents are well known and many fluorescent agents are available commercially. Usually, these fluorescent agents are supplied and used in the form of their alkali metal salts, for example, the sodium salts. Preferred classes of fluorescent agent are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2-(4-styryl-3-sulfophenyl)-2H-napthol [1,2-d]trazole, disodium 4,4'-bis{[(4-anilino-6-(N methyl-N-2 hydroxyethyl) amino 1,3,5-triazin-2-yl)] amino}stilbene-2-2' disulfonate, disodium 4,4'-bis {[(4-anilino-6-morpholino-1,3,5-triazin-2-yl)]annino}stilbene-2-2' disulfonate, and disodium 4,4'-bis(2-sulfoslyryl)biphenyl.

Cleaning polymers: The detergent composition may comprise cleaning polymers. For example, the detergent composition may comprise amphiphilic alkoxylated grease cleaning polymers, which may have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkyleneimines, for example. Such compounds may comprise, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The alkoxylated polyalkyleneimines may have an inner polyethylene oxide block and an outer polypropylene oxide block. Other suitable cleaning polymers include polyester based soil release polymers, such as SRA300, supplied by Clariant. The detergent compositions may comprise from 0.1% to 10%, preferably, from 0.1% to 8%, more preferably from 0.1% to 6%, by weight of the detergent composition, of alkoxylated polyamines.

Hydrotrope: The detergent composition may comprise, based on the total detergent composition weight, from 0 to 30%, preferably from 0.5 to 5%, more preferably from 1.0 to 3.0%, which can prevent liquid crystal formation. The addition of the hydrotrope thus aids the clarity/transparency of the composition. Suitable hydrotropes comprise but are not limited to urea, salts of benzene sulphonate, toluene sulphonate, xylene sulphonate or cumene sulphonate. Suitable salts comprise but are not limited to sodium, potassium, ammonium, monoethanolamine, triethanolamine. Preferably, the hydrotrope is selected from the group consisting of propylene glycol, xylene sulfonate, ethanol, and urea to provide optimum performance.

Process of Making the Detergent Composition

The process of making the detergent composition of the present invention comprises the step of:

a) Activating the cellulose fibers wherein at least 80% of said cellulose fibers have a hydrodynamic radius above 5 microns in solution using a homogeniser at a pressure of at least 80 bars;
b) Dispersing the cellulose fibers in a surfactant solution using shear to form a structured surfactant composition;
c) Combining the structured surfactant composition with an encapsulated benefit agent.

The above mentioned steps can be done in any suitable order. For instance, the cellulose fibers can be dispersed in the surfactant solution before activation. The surfactant solution can comprise additional ingredients, such as optional ingredients as described earlier. Preferably the cellulose fibers wherein at least 80% of said cellulose fibers have a hydrodynamic radius above 5 microns are added to the surfactant as a pre-mix with water, either before or after activation.

The homogenisation is done at a pressure difference of at least 80 bars, preferably from 80 to 1200 bars, more preferably from 150 bars to 600 bars. Suitable homogenisers include the PANDA from GEA.

The cellulose fibers can be dispersed in the surfactant composition using any suitable shear means, such as the Ultra Turrax device from IKA, T25 S 25 N-25 G-ST, using a speed of from 6,000 to 30,000 rpm for 2 to 20 minutes. If a lower shear rate is used, a longer dispersion time is required. Sufficient shear has been applied when the viscosity has stabilized.

Preferably the encapsulated benefit agent is added after the surfactant.

Method of Treating a Textile

The method of treating textile according to the present invention comprises the steps of:

a) Contacting the surface of the textile (e.g., fabric) with the detergent composition according to the present invention; then
b) rinsing the surface of the textile.

The contacting step may occur during a pretreatment step, where the detergent composition is applied directly to the textile, or during washing of the textile in a wash liquor comprising water and the detergent composition.

During the rinsing step, the fabric may be contacted with a fabric softener composition, wherein said fabric softener composition comprises a fabric softening active. The step of contacting the fabric with a fabric softening composition may occur in the presence of water, for example during a rinse cycle of an automatic washing machine.

The detergent composition of the present disclosure may be used in combination with other compositions, such as fabric additives, rinse aids, and the like.

Use of Cellulose Fibers

One other aspect of the present invention is the use of cellulose fibers wherein at least 80% of said cellulose fibers have a hydrodynamic radius above 5 microns to increase the deposition and/or retention of encapsulated benefit agent on fabrics. The preferred substrate for deposition is fabrics.

Preferably, cellulose fibers are used when incorporated in a composition according to the present invention.

The use of cellulose fibers wherein at least 80% of said cellulose fibers have a hydrodynamic radius above 5 microns is particularly applicable for compositions which comprise perfume capsules which are in the form of core-shell capsules.

Methods

Method of Determination of the Cellulose Level in Finished Product:

Sample preparation: the detergent composition is diluted 10 times its weight with demineralised water and centrifuged at 5000 rpm for 90 minutes. The solid fraction is collected at the bottom and washed 3 times with 4 times its weight of demineralised water. Then, the solid fraction is dried in the oven at 50° C. for at least 24 hours or until the weight is constant. This procedure is repeated as many times as required in order to collect 1 gram of solid fraction.

The cellulose is quantified after acid hydrolysis of the obtained solid, and the sugars released in the hydrolysate are determined using the High Performance Liquid Chromatography (HPLC) method described in the Laboratory Analytical Procedure NREL/TP-510-42618 (National Renewable Energy Laboratory, Version 07-08-2011). From the HPLC data, cellulose is determined by counting the weight of glucan measured.

Method of Measurement of the Hydrodynamic Radius of Fibers

The instrument used is the Malvern Mastersizer 2000 Hydro 2000MU particle size analyser from Malvern Instruments with the software Mastersizer 2000 version 5.60 from Malvern Instruments.

Sample Preparation:

A) Microfibrous Cellulose Raw Material:

A cellulose fibers sample is prepared by adding between 1% dry matter of cellulose fibers to water and activating it with a high pressure homogenizer (PANDA from GEA, 350 bars, 10 passes).

B) Detergent Composition Comprising Cellulose Fibers:

The detergent composition sample is centrifuged at 4,000 rpm for 10 minutes using a 5804 centrifuge from Eppendorf, in order to remove the capsules to avoid interference in the measurement of the fiber size. The clarified detergent composition is then decanted as the supernatant. The cellulose fibers present in the detergent composition (supernatant) are redispersed using an Ultra Turrax device from IKA, T25 S 25 N-25 G-ST, at a speed of 21,000 rpm for 10 minutes.

Measuring Hydrodynamic Radius:

The instrument cell is cleaned and then filled with demineralised water. If the background has a laser intensity above 79%, the system is considered clean and the sample can be added to the vessel until the desired obscuration is achieved. Then ultrasounds are switched on for 30 seconds and once the sample is well dispersed, the measurement can start.

Then, the volume weight mean [4,3] is measured. The hydrodynamic radius can be obtained by dividing the volume weight mean [4,3] by 2. The hydrodynamic radius is the radius of the equivalent sphere that has the same translational diffusion coefficient as the fiber being measured assuming a hydration layer surrounding the fiber.

Sampler selection: Hydro 2000MU

Sampler settings:

- Pump/stir speed: 2500 rpm
- Ultrasonics: 30 seconds

Material:

- Refractive Index of the material: 1.53
- Dispersant used: demineralised water in an amount as needed
- Particle shape: Irregular Measurement:

- Measurement cycles: 3 measurements per aliquot with a delay of 10 seconds
- Measurement time: 10 seconds
- Measurement snaps: 10,000
- Background time: 10 seconds
- Background snaps: 10,000
- Lower obscuration limit: 5
- Upper obscuration limit: 15

Measurement of the Amount of Perfume in the Fabric Headspace:

White knitted cotton fabric (5×5 cm) (from Warwick Equest) fabric samples, originating from rinse or wash cycles, are analyzed by fast headspace GC/MS using a Agilent DB-5UI 30m×0.25×0.25 column (part #122-5532UI) in splitless mode. Each white knitted cotton fabric is transferred into 25 ml headspace vials. The fabric samples are allowed to equilibrate for 10 minutes @ 65° C. before the headspace above the fabrics is sampled using a 23 gauge 50/30 UM DVB/CAR/PDMS SPME fiber (Sigma-Aldrich part #57298-U) for 5 minutes. The SPME fiber is subsequently on-line thermally desorbed into the GC using a ramp from 40° C. (0.5 min) to 270° C. (0.25 min) at 17° C./min. The perfume raw materials with a molecular weight between 35 and 300 m/z are analyzed by fast GC/MS in full scan mode. The amount of perfume in the headspace is expressed as nmol/L.

Examples

The launder-o-meter (launder-o-meter procedures are described in the Technical Manual of the AATCC, volume 71, 1996).

3.4 grams of a detergent composition (might already contain cellulose fibers and perfume capsules as described in the table 1 below) are added to 196.6 grams of industrial water (2.5 mmol/L hardness).

The Launder-o-meter jar is filled in with this solution, two pieces of white knitted cotton fabric (5×5 cm) (from Warwick Equest) are introduced in the jar and the jar is properly closed. The main wash is set up at 30° C. for 20 minutes, then the launder-o-meter is stopped and the fabrics are taken out without wringing.

200 mL of industrial water (2.5 mmol/L hardness) are added to the jar with the washed fabrics for the rinse of the fabrics. The Launder-o-meter is set up at 30° C. for 5 minutes. The fabrics are taken out from the jar and left on a flat surface (at 20° C. and 40% humidity) for 24 hours to dry.

Capsules present on the fabric are broken, perfume is extracted with methanol and is analyzed by Mass Spectrometry (API 3000 (I 114) from AB Sciex).

A dilution of 100 times is applied and the amount of perfume analysed is expressed in μg perfume/gram of cotton.

The following detergent compositions are prepared:

| | Example: | | | | | |
|---|---|---|---|---|---|---|
| | A* | B* | 1 | 2 | 3 | 4 |
| Ingredient: | % wt[7] | | | | | |
| C12-45 alkyl-7-ethoxylated | | | 2.34 | | | |
| C12-14 alkyl-7-ethoxylated | | | 0.2 | | | |

-continued

| Ingredient: | Example: A* | B* | 1 | 2 | 3 | 4 |
|---|---|---|---|---|---|---|
| | % wt[7] | | | | | |
| Monoethanolamine: $C_{12-14}$ EO•3•$SO_3H$ | 0.5 | | | | | |
| Linear alkyl benzene sulfonic acid | 4 | | | | | |
| sodium hydroxide | 1.9 | | | | | |
| sodium cumene sulfonate | 0.18 | | | | | |
| citric acid | 1.4 | | | | | |
| C12-18 Fatty acid | 1.1 | | | | | |
| Solvents (1,2-Propanediol, Ethanol) | 1.1 | | | | | |
| Chelants | 0.2 | | | | | |
| Soil suspending alkoxylated polyalkylenimine polymer[1] | 0.68 | | | | | |
| Minors (stabilizers, preservatives . . .) | 1 | | | | | |
| Hydrogenated castor oil | 0.6 | — | — | — | — | — |
| Wood fiber[2] (Lattice NTC 70 from FMC) | — | 0.6 | — | — | — | — |
| Wood fiber (Exilva ® from Borregaard) | — | — | 0.6 | — | — | 0.6 |
| Citrus fiber[4] (Citri-Fi 100FG from Fiberstar) | — | — | — | 0.6 | — | — |
| Wood Fiber (Cellulose Nanofibrils from Maine University) | — | — | — | — | 0.6 | — |
| Perfume benefit agent added via perfume capsules[5] (28.26% perfume) | 5.5 | 5.5 | 5.5 | 5.5 | 5.5 | — |
| Perfume benefit agent added via perfume capsules[6] (29.3% perfume) | — | — | — | — | — | 5.5 |
| water | up to 100 | | | | | |
| Cellulose fiber hydrodynamic radius in microns | NA | 5.75 | 14.5 | 34.65 | 52.5 | 14.5 |
| % fibers with a hydrodynamic radius above 5 microns | NA | 42.5 | 92.5 | 96.09 | 95.4 | 92.5 |
| Micrograms perfume/gram fabric in fabric headspace[8] | 715 | 793 | 3,877 | 4,416 | 5,527 | 6,007 |

*Comparative

From table 1 above, we can observe that cellulose fibers wherein at least 80% of said cellulose fibers have a hydrodynamic radius above 5 microns (compositions 1 to 4) surprisingly increase the deposition and/or retention of perfume capsules onto fabric as compared to products without cellulose fibers (composition A) or products containing cellulose fibers wherein said cellulose fibers have a hydrodynamic radius below 5 micron (composition B).

[1] 600 g/mol molecular weight polyethylenimine core with 24 ethoxylate groups per —NH and 16 propoxylate groups per —NH. Available from BASF (Ludwigshafen, Germany)

[2] A 4% aqueous slurry of Lattice NTC 70 is prepared using a high pressure homogenizer PandaPlus from GEA (80 bars, 5 passes), then this slurry is added in the last step by using a Ultra-turrax with S 25 N-18 G-ST Dispersing element from IKA

[3] Betafib is added in the last step by using an Ultra-turrax with S 25 N-18 G-ST Dispersing element from IKA

[4] A 3.8% aqueous slurry of Citri-Fi 100FG is prepared using a high pressure homogenizer PandaPlus from GEA (350 bars, 10 passes), then this slurry is added in the last step by using a Ultra-turrax with S 25 N-18 G-ST Dispersing element from IKA

[5] perfume capsules: Suitable perfume capsules can be purchased from Encapsys, 825 East Wisconsin Ave, Appleton, Wis. 54911), and are made as follows: 25 grams of butyl acrylate-acrylic acid copolymer emulsifier (Colloid C351, 25% solids, pka 4.5-4.7, (Kemira Chemicals, Inc. Kennesaw, Ga. U.S.A.) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, N.J., U.S.A.)) is added to the emulsifier solution. 200 grams of perfume oil is added to the previous mixture under mechanical agitation and the temperature is raised to 50° C. After mixing at higher speed until a stable emulsion is obtained, the second solution and 4 grams of sodium sulfate salt are added to the emulsion. This second solution contains 10 grams of butyl acrylate-acrylic acid copolymer emulsifier (Colloid C351, 25% solids, pka 4.5-4.7, Kemira), 120 grams of distilled water, sodium hydroxide solution to adjust pH to 4.8, 25 grams of partially methylated methylol melamine resin (Cymel 385, 80% solids, Cytec). This mixture is heated to 85° C. and maintained overnight with continuous stirring to complete the encapsulation process. A volume-mean particle size of 18 microns is obtained.

[6] 86 wt % core/14 wt % wall Melamine Formaldehyde (MF) perfume capsule coated with a polyvinylformamide deposition aid. 14 milliliters of the aqueous suspension of perfume capsules obtained as per the above are placed in a 20 milliliter centrifuge tube. 6 identical tubes are prepared and placed in a batch centrifuge (IEC Centra CL2). After 20 minutes at 3800 RPM, the centrifuge tubes are removed, and three layers are observed: perfume capsule cake layer on top, followed by an aqueous layer, followed by a high density solid particulate layer. The top capsule layer is isolated from the remaining material, and reconstituted to make a phase stable suspension. To 20.8 grams of the top perfume capsule layer is added 10.6 grams of DI water, then 1.6 grams of urea (Potash Corporation), 6.0 grams of 1 wt % aqueous solution of Optixan Xanthan Gum (ADM Corporation), and 2.4 grams of 32 wt % magnesium chloride solution (Chemical Ventures). 0.5 grams of a cationic modified co polymer of poly vinylamine and N-vinyl formamide (BASF Corp) is added.

[7] Every weight percent (% wt) of cellulose fibers refers to the dry matter.

[8] Average of 3 external and 2 internal replicates (6 in total per leg)

The following detergent compositions were prepared, and washed using the same procedure as described above. The perfume present in the fabric headspace was then measured:

| | Example C* % wt | 5 % wt | 6 % wt | 7 % wt |
|---|---|---|---|---|
| C12-45 alkyl-7-ethoxylated | 5.2 | 5.2 | 5.2 | 5.2 |
| Sodium: $C_{12-14}$ EO3$SO_3H$ | 3.1 | 3.1 | 3.1 | 3.1 |
| Linear alkyl benzene sulfonic acid | 7.2 | 7.2 | 7.2 | 7.2 |
| sodium hydroxide to pH 8 | 1.9 | 1.9 | 1.9 | 1.9 |
| sodium cumene sulfonate | 2.1 | 2.1 | 2.1 | 2.1 |
| C12-18 Fatty acid | 3.7 | 3.7 | 3.7 | 3.7 |
| Chelants | 0.35 | 0.35 | 0.35 | 0.35 |
| Soil suspending alkoxylated polyalkylenimine polymer[1] | 1.2 | 1.2 | 1.2 | 1.2 |
| Minors (stabilizers, preservatives . . .) | 1 | 1 | 1 | 1 |
| Hydrogenated castor oil | 0.3 | — | — | — |

-continued

| | Example | | | |
|---|---|---|---|---|
| | C* % wt | 5 % wt | 6 % wt | 7 % wt |
| Wood fiber (Exilva ® from Borregaard)[9] | — | 0.1 | 0.4 | 0.6 |
| Perfume added via perfume capsules[7] (29.3% perfume) | 0.4 | 0.4 | 0.4 | 0.4 |
| water | up to 100 | | | |
| average nmol/L of perfume in fabric headspace[8] | 319 | 1762 | 3585 | 4172 |

*Comparative

[9]As used in the composition of example 1.

Comparing the level of perfume available in the fabric headspace, in can be seen from the results of examples 5 to 7, in comparison with the results from comparative example C, that the higher the level of the cellulose fibers, the higher the amount of encapsulated perfume deposited onto the fabrics during the wash, leading to greater perfume in the headspace of the washed fabric.

The following detergent compositions were prepared, and washed using the same procedure as described above. The perfume present in the fabric headspace was then measured:

| | Example: | |
|---|---|---|
| Ingredient: | D* % wt | 9 % wt |
| C12-45 alkyl-7-ethoxylated | 5.2 | 5.2 |
| Sodium: $C_{12-14}$ EO•3•$SO_3H$ | 3.1 | 3.1 |
| Linear alkyl benzene sulfonic acid | 7.2 | 7.2 |
| sodium hydroxide to pH 8 | 1.9 | 1.9 |
| sodium cumene sulfonate | 2.1 | 2.1 |
| C12-18 Fatty acid | 3.7 | 3.7 |
| Chelants | 0.35 | 0.35 |
| Soil suspending alkoxylated polyalkylenimine polymer[1] | 1.2 | 1.2 |
| Minors (stabilizers, preservatives . . .) | 1 | 1 |
| Hydrogenated castor oil | 0.3 | — |
| Wood fiber (Exilva ® from Borregaard)[9] | — | 0.3 |
| Perfume added via perfume capsules[7] (29.3% perfume) | 0.4 | 0.4 |
| water | to 100 | |
| average nmol/L of perfume after main wash | 10477 | 12554 |
| average nmol/L of perfume after first rinse | 2898 | 8632 |
| average nmol/L of perfume after second rinse | 1857 | 6950 |

The results show that retention of deposited perfume capsules in the fabrics after rinsing is higher in the presence of the cellulose fibers.

The following composition was prepared and encapsulated to form a unit dose article:

| | Wt % |
|---|---|
| alkyl alkoxylated alcohol (C13-15-EO -BO)[10] | 27.3 |
| alkyl branched ethoxylated alcohol (C10-EO4)[11] | 40.0 |
| linear alkyl ethoxylate hueing dye present as a 12 wt % active in 1,2-propanediol | 1.2 |
| Acrylate/styrene opacifier premix[12] | 4.2 |
| 1,2 Propanediol | 16.4 |
| Glycerol | 5.0 |
| 5% EXILVA ® slurry (cellulose fibers in water)[9] | 5.9 |

[10]commercially supplied as Plurafac LF223, supplied by BASF, Ludwisghaven, Germany

[11]commercially supplied as Lutensol XP40, supplied by BASF, Ludwisghaven, Germany

[12]commercially available as OP305; 30 wt % active in 1,2-propanediol

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition, comprising, based on the total detergent composition weight:

a) from about 1.0% to about 90% of a detersive surfactant;

b) from about 0.01% to about 5% of cellulose fibers wherein at least about 80% of said cellulose fibers have a hydrodynamic radius above about 5 microns, and c) from about 0.05% to about 10% of encapsulated benefit agent.

2. The detergent composition according to claim 1, wherein at least about 80% of said cellulose fibers have a hydrodynamic radius between about 5 and about 65 microns.

3. The detergent composition according to claim 1, wherein at least about 80% of said cellulose fibers have a hydrodynamic radius between about 10 and about 55 microns.

4. The detergent composition according to claim 1, comprising, based on the total detergent composition weight, from about 0.05 to about 2.5% of said cellulose fibers.

5. The detergent composition according to claim 1, wherein the encapsulated benefit agent is selected from the group consisting of perfume composition, moisturizers, a heating agent, a cooling agent, an insect/moth repellent, germ/mold/mildew control agents, softening agents, hueing dyes, enzymes and combinations thereof.

6. The detergent composition according to claim 5, wherein the encapsulated benefit agent is a perfume composition.

7. The detergent composition according to claim 5, said encapsulated benefit agent is encapsulated in capsules wherein said capsules comprise a capsule wall, said capsule wall comprising wall material selected from the group consisting of melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals, starch, cellulose acetate phthalate, and mixtures thereof.

8. The detergent composition according to claim 5, said encapsulated benefit agent is encapsulated in capsules wherein said capsules comprise a capsule wall, said capsule wall comprises one or more wall material comprising melamine, polyacrylate based material and combinations thereof.

9. The detergent composition according to claim 1, comprising, based on the total detergent composition weight, from about 0.00001% to about 5% of a deposition aid in addition to said cellulose fibers.

10. The detergent composition according to claim 9, wherein the deposition aid in addition to said cellulose fibers is selected from the group consisting of polyvinylformamide, partially hydroxylated polyvinylformamide, polyvinylamine, polyethylene imine, ethoxylated polyethylene imine, polyvinylalcohol, polyacrylates, and combinations thereof.

11. The detergent composition according to claim 1, having a pH of from about 5 to about 12.

12. The detergent composition according to claim 1, wherein the cellulose fibers are derived from wood or jute.

13. A process of making the detergent composition of claim 1, comprising the steps of:

a) activating the cellulose fibers wherein at least above 80% of said cellulose fibers have a hydrodynamic radius above about 5 microns in solution using a homogeniser at a pressure of at least about 80 bars;

b) dispersing the cellulose fibers in a surfactant solution using shear to form a structured surfactant composition;

c) combining the structured surfactant composition with an encapsulated benefit agent.

14. The process according to claim 13, wherein said cellulose fibers are added to the surfactant as a pre-mix in water.

15. A method of treating a textile comprising the steps of:

a) contacting the textile with the detergent composition according to claim 1;

b) rinsing the surface of the textile.

16. The method of treating a textile according to claim 15, wherein the contacting step occur in the presence of water, where the water and the detergent composition form a wash liquor.

* * * * *